United States Patent [19]

Smith

[11] 4,137,448

[45] Jan. 30, 1979

[54] PUTTING STROKE CALCULATOR

[76] Inventor: William J. Smith, 17 Mildred Rd., West Hartford, Conn. 06107

[21] Appl. No.: 729,400

[22] Filed: Oct. 4, 1976

[51] Int. Cl.[2] ..... G06C 27/00; G06C 3/00; A63B 55/00

[52] U.S. Cl. ..... 235/78 G; 235/88 G; 273/32 H

[58] Field of Search ..... 235/78, 88, 70 A, 84; 33/1 SB; 116/133; 273/32 H

[56] References Cited

U.S. PATENT DOCUMENTS

| | | | |
|---|---|---|---|
| 3,282,500 | 11/1966 | Pikus | 235/70 A |
| 3,363,836 | 1/1968 | Lee | 235/78 G |
| 3,443,750 | 5/1969 | Slavin et al. | 235/78 F |
| 3,627,200 | 12/1971 | Sadler | 235/88 G |
| 3,701,471 | 10/1972 | Kurland | 235/78 G |
| 4,001,551 | 1/1977 | Hirsimaki | 235/70 A |
| 4,026,463 | 5/1977 | Betzler | 235/78 R |

OTHER PUBLICATIONS

Publication "Golf Calculator" by Philip M. Banner.

*Primary Examiner*—Stephen J. Tomsky
*Attorney, Agent, or Firm*—Joseph R. Spalla

[57] ABSTRACT

A device for enabling a golfer to determine the proper length of putting stroke according to the distance between ball and hole and according to the lie of the ball. The device comprises a plurality of scales representing relationships between putting strokes and putt distances for various lies. According to visual estimates of the distance and lie of a ball, be it flat, uphill, downhill or sidehill, a golfer may read out from the scales the corresponding putt stroke and aim necessary to hole a putt of any distance and lie.

3 Claims, 4 Drawing Figures

PUTTING STROKE CALCULATOR

The invention relates to a device for determining putting strokes necessary to hole a golf ball; more particularly, it relates to a device having relatively movable scales representing plotted values of putting strokes and putting distances which are settable relative to one another to establish the proportionality between putting strokes and putting distances; and specifically, to a device wherein the scales represent the antilogs of the logs of the variables of equations defining the relationship between putting distances and putting strokes at various lies.

In the game of golf, the greatest degree of skill is required after the ball is on the green and is next to be holed.

A player must judge distance to the hole and adjust his stroke. Oftentimes, the stroke is either too short or too long with the result that the ball stops short, or, unless the line of movement is directly toward the cup, goes beyond the cup. Putting is further complicated by the lie of the green with the result that a ball may be uphill, downhill or sidehill of the cup.

In accordance with the invention, it is assumed that a putter acts as a simple pendulum and that the rolling frictional force of greens on a given day is a constant. The distance through which a ball moves, according to these assumptions, is proportional to the square of the putting stroke. The equations expressing the relationship in logarithm form lend themselves to solution with familiar log scales. More particularly, logarithm scales are determined for strokes and distances and the corresponding antilogarithms are plotted on first and second scales.

Thereafter, by measuring the distance through which a ball is driven on a practice flat green with a given stroke, the first and second scales can be initially set. Thereafter, to read the putt stroke required for a flat distance faced by a golfer, he reads the putt stroke necessary from a scale opposite the distance faced on the distance scale. A third scale, representing vertical uphill/downhill heights between ball and hole, is used in conjunction with the second scale. By reading height on the third scale and reading the opposite distance on the second scale, a compensating distance is determined which, when added or subtracted from the distance faced, will indicate the stroke required for any uphill or downhill lie. Also, by using the distance scale and a separate sector of the third scale, a golfer can determine how much above the hole he must aim to allow for sidehill lies.

An object of the invention is in the provision of a device to enable putting stroke to be determined for various putting distances and lies faced by a golfer.

Other objects and many of the attendant advantages of the present invention will be readily appreciated as the same becomes better understood by reference to the following detailed description when considered in connection with the accompanying drawing in which like reference numerals designate like parts throughout the Figures thereof and wherein.

Figure 1:
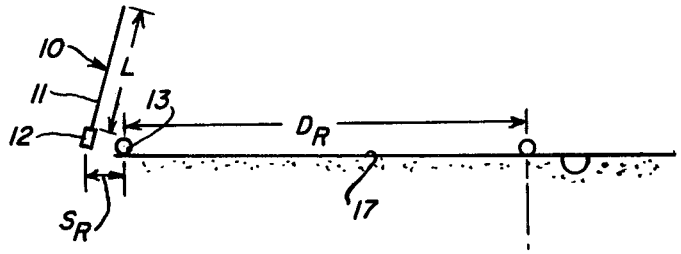
FIG. 1 is an elevational view of a ball on a flat green illustrating various relationships.

Referring now to the drawing wherein like reference numerals designate like or corresponding elements throughout, there is shown in FIG. 1 a putter generally designated by reference numeral 10 comprising a shaft 11 of length L at the end of which is a head 12 of mass M.

Though several assumptions are possible, the invention herein assumes that the motion of the putter 10 is that of a simple pendulum whose period is independent of amplitude. This assumption is reasonably valid and sufficiently accurate as the length L of the putter is large relative to a putting stroke S.

With these assumptions and employing the laws of motion and conservation of energy, the equation describing the relationship between putt stroke S and distance D can be derived as follows:

The velocity V of the head 12 at the time of impacting a golf ball 13 is $V = -S\omega \mathrm{Sin}\omega t$; where S = putting stroke length, $\omega = \sqrt{L/g}$ and t = time.

At the time of impact, where $\omega t$ is $\pi/2$, $\mathrm{Sin}\omega t = 1$. Therefore, $V\ max = S\omega$, or, $V\ max = S\sqrt{L/g}$ (1).

Since the mass M of the putter head 12 is much larger than the mass of the ball 13, the velocity of the ball 13 after impact by the putter head 12 will equal the velocity of the putter at impact.

From Conservation of Energy:

Kinetic Energy (initial) − K.E. (final) = Work Done.

Since the initial K.E. = $\frac{1}{2} M_{ball} V^2$, and the final K.E. = 0 (ball stopped), the Work Done = Force × Distances or FD.

Where F = Frictional Force of Green, D = Putt Distance.

Therefore, $F \cdot D = \frac{1}{2} M V^2$ (initial) or $D = MV^2/2F$ (2)

Substituting V from equation (1), we get $$D = M S^2 L/2 g F$$

As M. L, 2g and F are constants for a given putt on a given green, equation (2) can be reduced to $D = K S^2$ (3)

Where $K = ML/2gf$,

In logarithm form equation (3) becomes $\mathrm{Log}\ D = \mathrm{Log}\ K + 2\ \mathrm{Log}\ S$.

Figure 4:
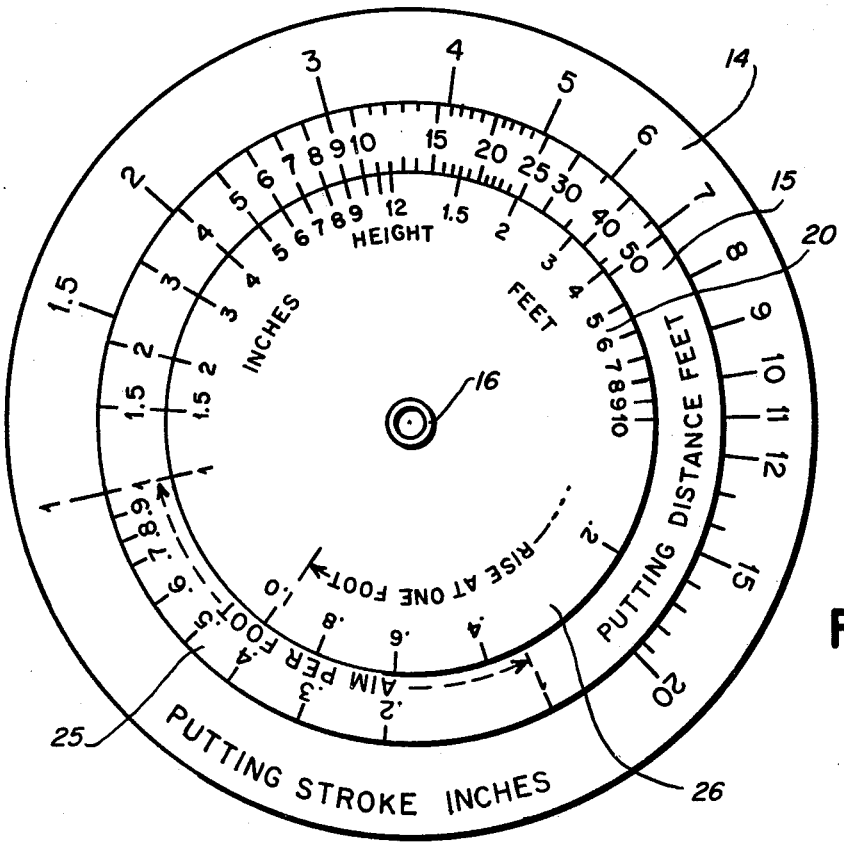
FIG. 4 is an elevational view of a device in accordance with the invention.

With reference to FIG. 4, a circular putting stroke scale 14 representing the plotted antilogs for a series of log S numbers is marked off in inches and a circular putt distance scale 15 representing the plotted antilogs of a series of two times log S number is marked off at convenient increments. Scale 15 is rotatably mounted for movement relative to scale 14 as by a pivot 16 in the form of a eyelet. The friction between the relatively moving scales is sufficient to prevent accidental movement relative to one another. It should be understood, however, that a more positive locking means could be employed.

With reference to FIG. 1, when a golfer uses a given or reference putting stroke $S_R$ of say 4 inches on a flat green 17 and gets a distance $D_R$ of 10 feet, K of equation (3) is automatically determined. In other words, by putting on the green 17, a golfer has, in effect, calculated K, squared $S_R$ and taken their product, i.e. $D_R$ for the particular condition of the green 17 without physically doing the calculation.

Thus, by moving distance scale 15 such that 10 feet on the distance scale 15 is opposite 4 inches on the putt stroke scale 14, the proportionality constant K is set in. Now, a putting stroke S may be determined for any putt distance D on a flat green 17 (FIG. 1) faced by a golfer by matching distances on scale 15 opposite strokes on scale 14.

Figure 2:
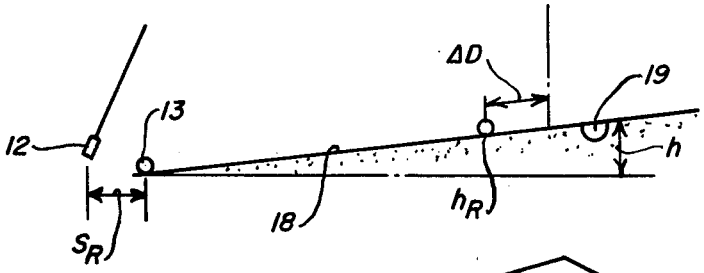
FIG. 2 is a view similar to FIG. 1 showing a ball on an inclined green and the relationships involved.

Referring now to FIG. 2, there is shown an uphill green 18 wherein the hole 19 is at a height h above the ball 13. It is evident that with the same putting stroke $S_R$, the ball 13 will not travel the same distance it travelled on a flat green 17. Assuming the green 18 on the uphill lie is in the same condition as green 17, the controlling equations for determining the uphill compensation distance are derived as follows:

From equation (2), $D_{flat} = MV^2/2F$

In an uphill putt, some of the Kinetic Energy is transferred into Potential Energy where P.E. = Weight of ball × height above initial position. Therefore, P.E. = W × h, where h = rise.

Thus, with the same Putting Stroke $S_R$, $\text{Distance}_{uphill} = (\frac{1}{2} M V^2)/F - Wh.$ Therefore, $D_{flat} - D_{uphill} = \Delta D$ (Compensating Distance)

Therefore, $\Delta D = 2 W h,/F$ or $$\Delta D = K_1 h \quad (4)$$

where $K_1 = 2W/F$.

In log form equation (4) becomes $$\log\Delta D = \log K_1 + \log h.$$

With reference again to FIG. 4, a third circular scale 20, with the same incremental spacing as scale 15, representing the plotted antilogs of a series of log h numbers is marked off and mounted on pivot 16 for movement relative to scale 15.

With reference again to FIG. 2, a golfer using the same putt stroke $S_R$ used on a flat green 17, will putt on the inclined practice green 18 and note the distance ΔD that the ball is short of the flat distance $D_R$ produced by the stroke $S_R$ on a flat lie, and will note the height $h_R$ of the ball 13. This, in effect, calculates the constant $K_1$. Then he sets the height $h_R$ on scale 20 opposite the ΔD on scale 15 and locks scales 15 and 20. Thereafter, when facing an uphill putt, he notes the height h between ball and hole on scale 20, reads off ΔD on scale 15 and adds ΔD to the putt distance D to the hole he faces, and then he reads scale 14 to get the proper putting stroke S opposite the cumulative distance on scale 15. For downhill putts, ΔD will be subtracted.

In other words, a golfer may read off the proper putting stroke S on scale 14 for an uphill or downhill lie opposite a distance D on scale 15 which is the sum or difference of the putt distance D faced and a compensating distance ΔD determined from a reading of ΔD on scale opposite the height h faced on scale 20.

To further illustrate, if the golfer is faced with a 10 foot uphill putt and the ball is h inches below the hole, he locates h on the Height scale 20 and reads the compensating distance ΔD directly opposite on the Distance scale 15. The compensating distance ΔD is added to the actual 10 foot distance to adjust for putting uphill, before reading the required putting stroke S opposite D + ΔD on scale 15.

More specifically if, assuming that scales 14 and 15 and 20 are set as shown in FIG. 4 following putting with a given putt stroke $S_R$ on a flat green, and following putting with the same stroke $S_R$ on an inclined green an explained above, a golfer is faced with a thirteen (13) foot putt distance on an uphill lie where the hole is 3 inches above the ball. The golfer will locate 3 inches on the height scale 20 and read the compensating distance of 3 feet on scale 15 which is opposite 3 inches on the height scale 20. This 3 feet compensating distance will be added to the 13 feet from ball to hole and the proper putt stroke of approximately 4 inches will be read on scale 14 opposite 16 feet on scale 15.

If a golfer is faced with a downhill putt, the compensating distance ΔD is subtracted from the total putt distance and the required putting stroke S will be read on scale 14 opposite D − ΔD on the Distance scale 15.

Figure 3:
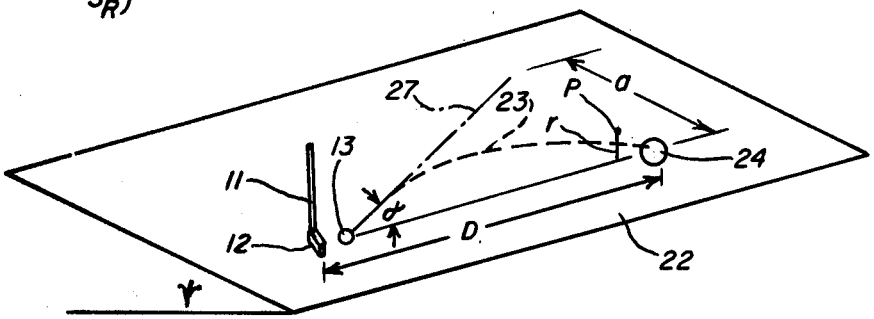
FIG. 3 is an elevational view showing a sidehill lie and the relationships involved.

With reference to FIG. 3, there is illustrated a sidehill green 22 with the relationships involved in the determination of how high above a hole to aim with a putting stroke S determined from scale 14 opposite the distance D faced on scale 15 as will enable a ball 13 to traverse on arc 23 and enter into the hole 24 with zero horizontal velocity.

The relationship, derived from equations of motion between slope and aim, is as follows:

$$\text{Sin}\alpha = \Delta D/2h \text{ Sin } \psi$$

Where $\text{Sin}\alpha$ = aim; $\sin\psi$ = slope or, $\log \sin\alpha = \log \frac{1}{2} + \log \Delta D/h + \log \sin\psi$.

The log sin α values for a series of angles α can be determined. As shown in FIG. 4, these values are plotted as antilogs of log Sin α on a sector 25 which is an extension of the Distance scale 15 and which is labelled aim/ft.

Assuming that ΔD/h = 1, and setting the "ones" on scales 15 and 20 opposite one another as illustrated in FIG. 4, the values of log sin ψ for each log sin α can be calculated. These log sin ψ values are marked on a sector 26 to the left of the height scale 20 with each value opposite corresponding antilogs of log sin α values. This properly locates sector 26 relative to scale 20 for any position of height scale 20 relative to scale 15. Sector 26 is, therefore, labelled "rise at one ft" i.e. sin ψ = rise/12 inches.

With sectors 25 and 26 so plotted and located relative to one another, a golfer faced with a sidehill putt looks at a point P, 1 foot above the hole 24, and estimates the vertical distance a (FIG. 3) between point P and the hole, e.g. a 1" rise. Finding 1" on the rise at 1 foot scale 26, he reads the number opposite on the aim/ft scale 25 and multiplies the putt distance D by the aim/ft number to give him the distance above the hole 24 to which he must aim along line 27 with the putting stroke S necessary to drive distance D.

The invention claimed is:

1. A device for determining the putting stroke required under existing green conditions to drive a golf ball through distances between the ball and a hole, said distances being proportional to the square of said putting stroke, comprising, a first element having a logarithmic putting stroke scale with scale divisions bearing number indicia representing putting strokes, a second element having a logarithmic putting distance scale with scale divisions bearing number indicia representing the squares of putting strokes, a third element having a logarithmic scale with scale divisions bearing number indicia representing heights between ball and hole on uphill or downhill lies, and means mounting said first and second elements for movement relative to one another for setting the putt distance on said second element scale opposite a given putt stroke on said first element scale which produced the putt distance to establish the proportionality between putting stroke and distance under existing green conditions, whereby thereafter the putting stroke necessary to drive a golf ball over any estimated distance between lie and hole may be read off the said first element scale opposite the estimated distance on said second element scale, said means mounting said first and second elements also mounting said third element for movement relative to said second element for setting the height on said third element scale achieved with said given putting stroke opposite a putting distance on the second element scale, which is the difference between the distance achieved by the given stroke over a flat surface and the uphill distance achieved by the given putting stroke, to establish a compensating distance under existing green conditions, whereby when faced with an uphill or downhill lie, the distance on the second element scale opposite the height faced on the first element scale which must be added to or subtracted from the uphill or downhill distance between ball and hole can be determined and the putting stroke required for the resulting distance can be read off the first element scale.

2. A device as recited in claim 1 including means for determining aim for a putting stroke read from said first element scale comprising a second logarithmic scale on a sector of said second element with scale divisions representing aim/foot of putt distance, and a second logarithmic scale on a sector of said third element with scale divisions representing height at 1 foot above a hole, said second scale on said second and third elements being used to establish aim by noting the height of the hole at a point 1 foot above the hole on the second scale of said third element and reading the aim/foot on the second scale of said second element which when multiplied by the putt distance on the first scale of said second element will advise the golfer how far above the hole to aim.

3. A device as recited in claim 1, said first, second and third elements being circular, said third element diameter being smaller than said second element diameter and said second element being smaller than said first element diameter.

* * * * *